United States Patent [19]

Winfree, Jr.

[11] 4,116,342

[45] Sep. 26, 1978

[54] BILLIARDS CUE HOLDER

[76] Inventor: John W. Winfree, Jr., 1502 S. Virginia St., Hopkinsville, Ky. 42240

[21] Appl. No.: 821,397

[22] Filed: Aug. 3, 1977

Related U.S. Application Data

[62] Division of Ser. No. 639,895, May 19, 1976, Pat. No. 4,079,839.

[51] Int. Cl.[2] ..... A44B 21/00

[52] U.S. Cl. ..... 211/68; 24/257; 248/316 D

[58] Field of Search ..... 248/316 D, 113; 211/66, 211/68, 698; 24/253, 255, 257 R

[56] References Cited

U.S. PATENT DOCUMENTS

| | | | |
|---|---|---|---|
| 380,320 | 4/1888 | Gash | 24/257 R |
| 616,657 | 12/1898 | Gaines | 24/255 R |
| 1,156,168 | 10/1915 | Minnich | 24/257 R |
| 1,810,304 | 6/1931 | Tangen | 24/253 |

*Primary Examiner*—J. Franklin Foss
*Attorney, Agent, or Firm*—Harrington A. Lackey

[57] ABSTRACT

A billiards cue holder including a coil spring, the opposite ends of which form depending arms terminating in a pair of opposed jaw elements having opposed soft resilient gripping surfaces for gripping the tip portion of a billiards cue. Means for mounting the coil spring at an elevated position upon a fixed support so that the opposed jaw elements will freely suspend the billiards cue in an operative position.

1 Claim, 4 Drawing Figures

BILLIARDS CUE HOLDER

CROSS-REFERENCE TO RELATED APPLICATION

This is a division of application Ser. No. 639,895, filed May 19, 1976 now U.S. Pat. No. 4,079,839.

BACKGROUND OF THE INVENTION

This invention relates to a billiards cue holder and more particularly to a holder for freely suspending the cue by its tip portion.

Most billiards cue holders are in the form of racks having a base upon which the butt of each cue rests for supporting the weight of the cue. Such racks are also provided with grooves, recesses, or other types of keepers for supporting the upper portions of the cues against lateral movement.

One type of holder or support for suspending a billiards cue by its tip end portion is disclosed in the German Muerer Patent No. 49,112 (1889). The German Patent No. 49,112 also discloses a base or butt-type support rack for a billiards cue.

SUMMARY OF THE INVENTION

It is an object of this invention to provide a billiards cue holder of novel construction particularly adapted to freely suspend the billiards cue by its tip end portion.

When a billiards cue is freely suspended and held only by its tip end portion, the entire weight of the cue tends to maintain the cue in a truly vertical position. The weight of the freely suspended cue is therefore constantly acting to stretch the grains of the wood downward, and thereby maintain the cue in a straight and true position.

The cue holder made in accordance with this invention includes a coil spring having a substantially straight coil axis. The opposite ends of the coil spring form depending arms terminating in a pair of opposed jaw elements, preferably having opposed soft resilient gripping surfaces. In its normal inoperative position, the forces in the coil spring are such that the opposed jaw elements are spaced apart a distance less then the diameter of the tip portion of the billiards cue to be gripped by the jaw elements.

An elongated fastener, such as a screw or nail having a length greater than the coil spring is provided to fix the coil spring upon a stationary support at an elevation substantially greater than the length of the billiards cue to be held by the cue holder. Thus, when the coil spring is fixed to the stationary support, the coil axis will project from and normal to the surface of the stationary support so that the jaw elements, and therefore the billiards cue, will not engage the stationary support, and the billiards cue will be freely suspended by the jaw elements.

In one embodiment of the invention, the jaw elements are spaced apart in a direction substantially parallel to the longitudinal axis of the coil spring, while in another embodiment, the jaw elements are spaced apart in a direction substantially normal to the longitudinal axis of the coil spring.

DESCRIPTION OF THE PREFERRED EMBODIMENT

Figure 1:
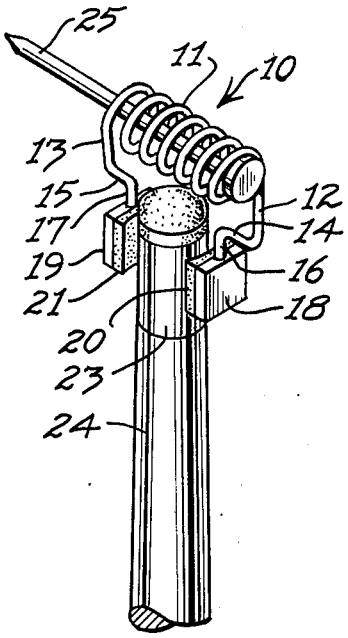
FIG. 1 is a top front perspective view of the cue holder made in accordance with this invention in operative position, suspending the tip portion of a billiards cue, disclosed fragmentarily.
Figure 2:
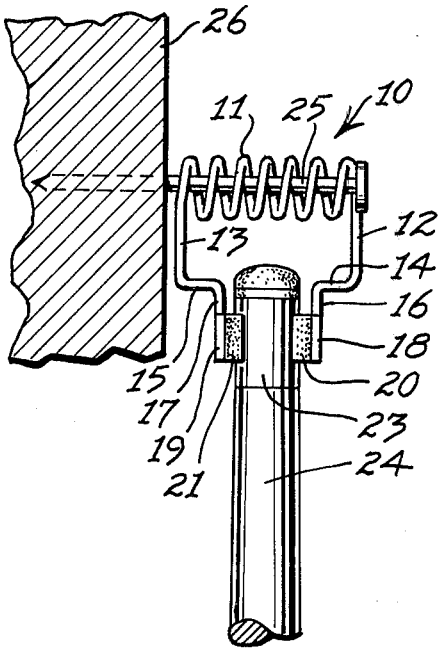
FIG. 2 is a side elevation of the cue holder disclosed in FIG. 1 mounted in an elevated operative position upon a stationary wall, shown fragmentarily, and suspending the billiards cue, also disclosed fragmentarily.

Referring now to FIGS. 1 and 2, the holder 10 comprises an elongated coil spring 11 having a substantially straight longitudinal axis. The opposite ends of the coil spring 11 form depending arms 12 and 13, which extend straight down, not only from opposite ends, but also from opposite sides of the vertical plane containing the longitudinal axis of the coil spring 11. The lower portions of the arms 12 and 13, which are preferably extensions of the wire forming the coil spring 11 are bent to project substantially horizontally to form inward extensions 14 and 15. The inner ends of the extensions 14 and 15 are again bent to depend vertically in substantially parallel jaw stems 16 and 17 terminating in enlarged jaws or jaw elements 18 and 19. The opposing faces of the jaw elements 18 and 19 are covered with soft and resilient gripping pads 20 and 21, preferably made of soft rubber or plastic. The coil spring 11 is so biased, and the arms 12 and 13 and jaw stems 18 and 19 are so constructed, that the jaw elements 16 and 17 are normally spaced apart a distance substantially less than the diameter of the tip portion 23 of a billiards cue 24 to be gripped and suspended by the cue holder 10.

However, when the jaw elements 18 and 19 are forced apart by the insertion of the tip portion 23 of the cue 24 between the resilient pads 20 and 21, the jaw elements 18 and 19 will be forced apart against the bias of the coil spring 11 to permit the tip portion 23 to be received and firmly gripped, in operative position, between the padded jaw elements 18 and 19, as disclosed in FIGS. 1 and 2.

The longitudinal axis of the coil spring 11 is preferably straight, and the diameter of the coil of the spring 11 is great enough that an elongated straight fastener member, such as the nail 25,may be easily inserted entirely through the length of the coil spring 11. The length of the nail 25 is substantially greater than the length of the coil spring 11, as disclosed in FIGS. 1 and 2, so that the nail 25 may be driven into a stationary support, such as the wall 26 (FIG.2), at an elevated position. The elevation of the cue holder 10 above the base of the stationary support 26, such as the floor of a room, not shown, is substantially greater than the length of the billiards cue 24, so that when the billiards cue 24 is securely gripped at its tip portion 23 by the jaw elements 18 and 19, the butt of the cue 24, not shown, will not engage the floor or any other fixed support. Thus, the billiards cue 24 will be suspended or hung from the cue holder 10, supported only by the engaging jaw elements 18 and 19, in a substantially vertical position. Thus, the weight of the cue 24 will tend to maintain the cue 24 straight and vertical.

Once the position of the jaw elements 18 and 19 has been set in their original inoperative position, in the original construction of the cue holder 10, and the desired force, strength and yielding ability of the coil spring 11 has been set in the original manufacture, the gripping pressure of the elements 18 and 19 upon the tip portion 23 of the billiards cue 24 to be suspended, will remain consistent, without further adjustment, for the life of the coil spring 11.

If desired, the inner faces of the jaw elements 18 and 19 may be arcuate to conform, or nearly to conform, to the curvature of the tip portion 23.

Figure 3:
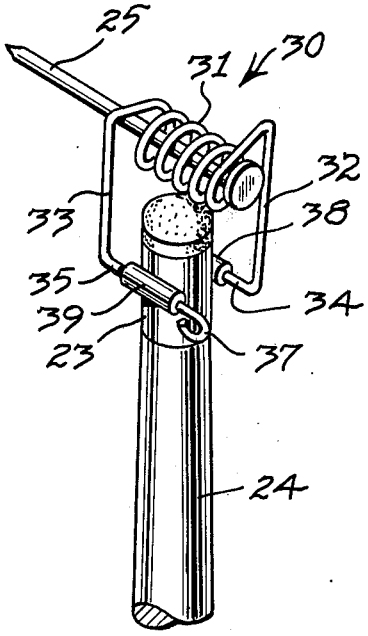
FIG. 3 is a perspective view similar to FIG. 1 showing a modified form of the invention.
Figure 4:
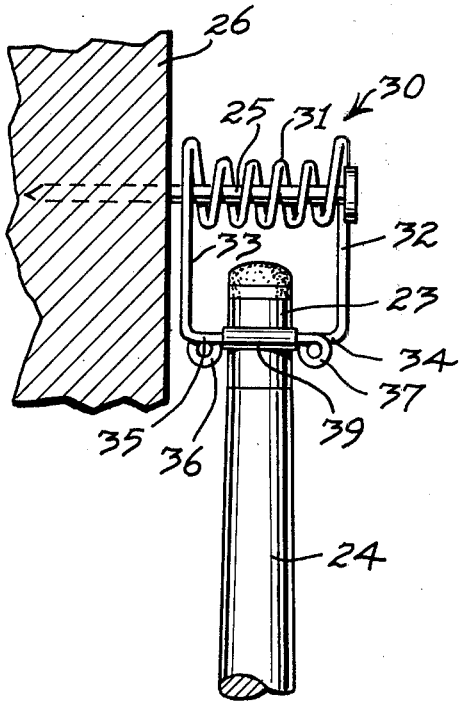
FIG. 4 is a side elevation similar to FIG. 2 disclosing the modified invention of FIG. 3.

Referring now to FIGS. 3 and 4, the cue holder 30 also includes an elongated coil spring 31 having a substantially straight coil axis. The opposite ends of the coil spring 31 also form depending arms 32 and 33 extending generally vertically from opposite ends of the coil spring 31 and also on opposite sides of a vertical plane containing the longitudinal axis of the coil spring 31.

However, the lower ends of the arms 32 and 33, which preferably are wire extensions of the coil spring 25, are bent at right angles to form inward horizontal projection and parallel opposed wire jaw elements 34 and 35. Each jaw element 34 and 35 terminates in an arcuate, reversely curved loop end or guide element 36 and 37, which functions as a guide at the end of the respective jaw element for guiding the billiards cue tip portion 23 between the closely spaced biased jaw elements 34 and 35.

Each of the wire jaw elements 34 and 35 is surrounded by a tubular or cylindrical, soft,resilient sleeve 38 and 39, respectively.

The padded jaw faces 20 and 21 of the cue holder 10 and the soft sleeve 38 and 39 of the cue holder 30 are designed not only to provide greater gripping surface areas for engaging the tip portion 23 of the cue 24, but also to prevent scarring or damage to the surface of the tip portion 23.

It will be noted in FIGS. 3 and 4, that the direction of spacing between the jaw elements 34 and 35 is substantially normal to the longitudinal axis of the coil spring 31. Consequently, the straight wire jaw elements 34 and 35, which are parallel to each other, are also parallel to the longitudinal axis of the coil spring 31.

The cue holder 30 is mounted upon a stationary support, such as the wall 26 at an elevated position in the same manner as the cue holder 10, namely by a straight fastener member, such as a nail 25 or a screw, having a length substantially greater than the coil spring 31, as shown in FIG. 4.

Assuming that the front of each cue holder 10 and 30 is the right end of the coil spring 11 and 31, respectively, in the drawings, then the cue 24 may be inserted between the jaws 18 and 19 from either the right side or the left side of the cue holder 10. On the other hand, the cue 24 may be fitted between the jaw elements 34 and 35 from the front of the cue holder 30. In the cue holder 30, the cue 24 might be inserted from the rear, if there is sufficient room between the rear ends of the jaw elements 34 and 35 and the wall 26.

It is also possible to insert the cue 24 by moving it straight up between the jaws in the cue holders 10 and 30.

Here again, the cue holder 30 is mounted on the stationary support 26 at an elevation above the floor or base greater than the length of the cue 24, so that the cue 24 is freely suspended, and supported only by the jaw elements 34 and 35 gripping the tip portion 23, so that the cue 24 hangs straight and vertical. Again, the weight of the billiards cue 24 tends to straighten itself while hanging from either holder 10 or 30.

What is claimed is:

1. A holder for a billiards cue having a tip portion of predetermined diameter, comprising:

(a) a pair of opposed jaw members, (b) each of said jaw members having a soft resilient gripping surface, said gripping surfaces opposing each other, (c) a coil spring member having a substantially straight coil axis and opposite end portions, (d) said opposite end portions of said coil spring member comprising spaced apart and depending arms, each of said depending arms having a lower portion, (e) each jaw member being fixed to a corresponding lower portion so that said opposed jaw members are spaced apart in a direction substantially parallel to said coil axis, (f) said jaw members being biased by the force in said coil spring to a normally inoperative position in which the distance between said opposed jaw members is less than the diameter of the tip portion of a cue to be held between said jaw members, (g) said coil spring being yieldable to permit said opposed jaw members to be spread apart by said tip portion to an operative position gripping said tip portion to freely suspend said cue, (h) an elongated fastener member adapted to extend substantially coaxially through said coil spring for mounting said jaw members in an elevated position upon a support member for freely suspending said cue in said operative position.

* * * * *

UNITED STATES PATENT OFFICE

CERTIFICATE OF CORRECTION

Patent No. 4,116,342 Dated September 26, 1978

Inventor(s) John W. Winfree, Jr.

It is certified that error appears in the above-identified patent and that said Letters Patent are hereby corrected as shown below:

The Figure on the Cover Sheet should read as shown below:

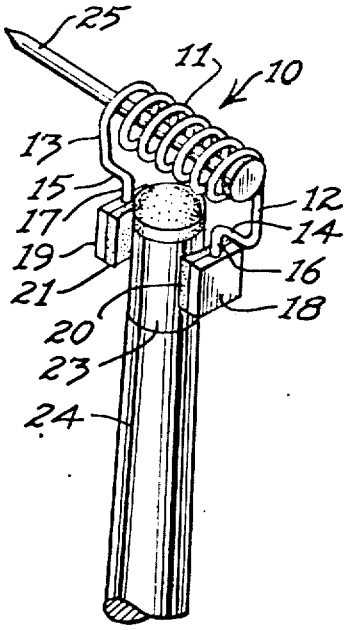

Signed and Sealed this

Second Day of January 1979

[SEAL]

Attest:

RUTH C. MASON
Attesting Officer

DONALD W. BANNER
Commissioner of Patents and Trademarks